United States Patent [19]

Benda

[11] 4,091,639

[45] May 30, 1978

[54] FRAME APPARATUS

[76] Inventor: Karl Benda, 224-74 Horace Harding Blvd., Bayside, N.Y. 11364

[21] Appl. No.: 738,135

[22] Filed: Nov. 2, 1976

[51] Int. Cl.[2] ..... A44C 15/00

[52] U.S. Cl. ..... 63/18; 40/152; 40/153; 63/23; 206/.82

[58] Field of Search ..... 40/1.5, 152, 153, 155, 40/152.1, 323; 63/18, 19, 29 R, 23; 206/.82, .83

[56] References Cited

U.S. PATENT DOCUMENTS

| | | | |
|---|---|---|---|
| 295,156 | 3/1884 | Dueber | 63/18 X |
| 377,567 | 2/1888 | Lowe | 40/153 |
| 1,534,684 | 4/1925 | Chilson | 63/18 X |
| 2,511,651 | 6/1950 | Schlitz | 63/19 X |
| 3,241,659 | 3/1966 | Segel | 206/.82 |
| 3,618,338 | 11/1971 | Sauer | 63/19 |
| 3,678,705 | 7/1972 | Korwin | 63/18 |
| 3,782,537 | 1/1974 | Segel | 206/.82 |

*Primary Examiner*—John F. Pitrelli

[57] ABSTRACT

A frame apparatus is disclosed which may comprise a pendant for mounting a coin, the frame having a first and second section defining an opening in the center thereof, the opening having flanges on either face thereof, defining a groove in between them. The frame sections have inner faces that are abutable against one another and outer edges which are secured to one another. One of the frames has a series of indentations positioned along the outer edge whereas the outer frame section has a plurality of bosses extending from the outer edge which are received by the indentations when the inner faces of the frames abut one another. A typing member is positioned around the outer edge of the frame sections such as a coil spring received in a groove that extends downwardly from the outer edges towards the center of the opening.

One end of the spring may be tapered for insertion into the opposite end of the spring to provide a removable connecting member. One or several of the coils of the spring may be enlarged to provide a loop through which a chain can be strung so that the frame may be worn as a pendant.

4 Claims, 3 Drawing Figures

FRAME APPARATUS

SUMMARY OF THE INVENTION

The present invention relates to a frame for encircling an article having a continuous edge and comprises a first frame section having an outer face and an inner face extending around a first opening. The first frame section has a first inner edge around the first opening, the first inner edge having a first flange member thereon projecting towards the center of the first opening. The first frame section also has a first outer edge with indentation members therein. A second frame section is also provided, the second frame having an outer face and an inner face, the second frame also extending around a second opening. The second frame has a second inner edge around the second opening and a second flange member thereon projecting toward the center of the second opening. The second frame section has a second outer edge and a plurality of boss members extending from the outer edge. A tying member is provided for securing the first frame and the second frame at the outer edges thereof. When the first frame and second frame are joined so that the inner faces of each are abutting one another, the first flange member and the second flange member define a groove between them opening toward the center of the first and second openings and the boss members are arranged to be received by the indentation members whereas the tying member is arranged to extend around the periphery of the first outer edge and the second outer edge.

The second opening may be of the same size as the first opening and coincidental therewith when the first frame section and the second frame section are joined with the inner faces of each abutting one another.

The indentation may comprise a rectangular indentation extending downward from the first outer edge, the boss member being arranged to fit flushly within the indentation and the outer edge of the boss member being coincidental with the second outer edge of the second frame.

The tying member may be arranged to extend around the periphery and to be received within a groove around the periphery of the first outer edge and the second outer edge.

The ends of the tying member may be releasably joinable to one another through a connecting member.

The tying member may comprise a resilient member so that when the tying member is positioned around the periphery of the first outer edge and the second outer edge, a biasing force is applied from the periphery towards the center of the first and second openings.

The tying member may comprise a coil spring having a plurality of helically continuous coils, the connecting member comprising one end of said spring having an inwardly tapered configuration for insertion into an opening into the opposite end of the spring.

The frame may comprise a pendant for mounting a coin in the groove formed between the first flange member and the second flange member, the first and second openings being rounded whereby the edge of a coin may be held in the groove and the face of the coin may be viewed through the opening.

At least one of the coils of the spring tying member may extend beyond the outer surface of the spring for securing a chain therethrough.

DETAILED DESCRIPTION

Pendants and coin holders are disclosed in the prior art U.S. Pats. Ringle No. 3,797,649; Handler et al. No. 3,686,894; Segel No. 3,782,537; Korwin No. 3,678,705; Kramer No. 3,635,335; Sauer No. 3,618,338; Winston No. 3,407,523; Schlitz No. 2,511,651 and Chilson No. 1,534,684.

It is one of the objects of the present invention to provide a novel frame and especially a frame which may be employed to mount an article for display such as a coin and which may be worn around the neck as a pendant.

It is another object of the present invention to provide a novel frame in which mating frame sections each defining an opening may be positioned around an article which is to be displayed and which may be secured to one another by a tying member that is easily secured to and detached from the frame section.

It is a further object of the present invention to provide a decorative frame which may be employed as a pendant.

It is also an object of the present invention to provide a frame comprising mating sections each of which define a common opening and which are held together by a tying member that is decorative in appearance and which may be used in employing the frame as a pendant.

These and other objects have been achieved according to the present invention and will become apparent by reference to the disclosure and claims that follow as well as the appended drawing.

Figure 1:
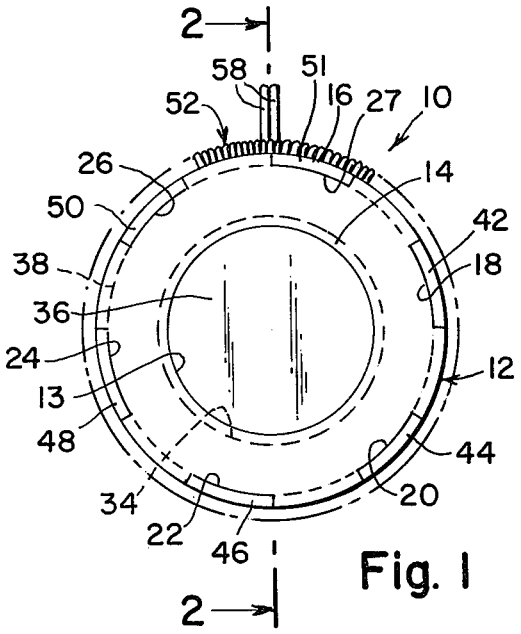
FIG. 1 comprises a plan view of a frame having a tying member around its outer periphery and an opening in the center thereof for viewing an object on display within the frame according to one embodiment of the present invention.
Figure 2:
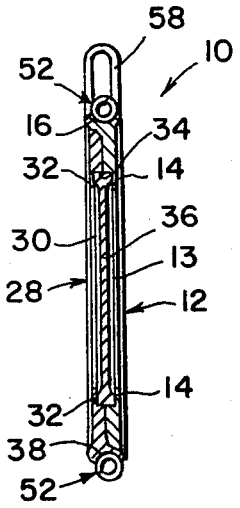
FIG. 2 comprises a side elevation in section taken along the line 2—2 of FIG. 1 and illustrates a first frame section and a second frame section having inner and outer faces, the inner faces abutting one another.
Figure 3:
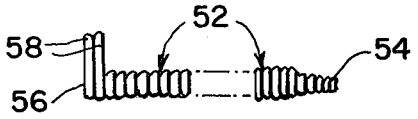
FIG. 3 comprises a partial side elevation of a tying member to be secured to the periphery of a frame illustrated in FIG. 1 in which the tying member comprises a coil spring, one end of which is tapered for insertion into the opposite end and two of the helical coils of the coil spring are enlarged for receiving a mounting member according to another embodiment of the present invention.

Referring to the drawing in FIGS. 1–3 therein, a frame 10 is provided comprising a first interlocking section 28 having an inner face and an outer face, the inner face of section 12 and the inner face of section 28 being abutable and positionable in a face to face relationship with respect to one another.

The frame section 12 has an opening 13 therein and a flange 14 extending around the opening 13, the flange 14 projecting towards the center of the opening 13. The frame section 12 has an outer edge 16 which is half round in cross section for receiving a rounded tying member such as a coil spring 52. Frame section 12 has a plurality of openings 18, 20, 22, 24 and 26 and 27 for receiving boss members extending from the frame 28 of the periphery thereof.

Frame 28 defines an opening 30 having a flange 32 thereon projecting towards the center of opening 30 so that when the frame section 12 and the frame section 28 abut one another as illustrated in FIG. 2 a groove 34 opening in a direction towards the center of the openings 13 and 30. The groove 34 is adapted to receive the edge of a coin 36 or other object mounted within the openings 13 and 30 of the frame sections which is to be displayed. Frame 28 has an outer edge 38 which is also half rounded in configuration and corresponds to and is an extension of the half rounded configuration 16 of the outer edge of the frame section 12. Frame 28 has a plurality of bosses 42, 44, 46, 48, 50 and 51 for insertion into the openings 18–27 respectively, the upper surfaces of the bosses 42–51 conforming to the outer edge 38 of the frame section 28. The bosses are adapted to fit flushly in the openings in the frame section 12 as is illustrated in FIGS. 1 and 2. A tying member is positioned around the outer edges of the frame sections 12 and 28 when these frame sections are in an abutting relationship as illustrated in FIG. 2. The tying member in one embodiment comprises a coil spring 52 having a plurality of helical coils, at least one of the coils (and as illustrated in FIG. 3, two of the coils) extending as enlarged coils for providing a mounting member which extends from the spring 52. One end of the spring 52 has a tapered configuration 54 for insertion into an opening 56 at the opposite end of the spring 52, the tapered end 54 providing a releasable locking mechanism for securing the spring 52 to the edges of the frame sections 12 and 28.

In one embodiment the frame 10 may comprise a pendant, the center of which has a coin 36 mounted therein by the edge as is illustrated in FIG. 2 in which the edge of a coin 36 is mounted in the center of the frame sections 12 and 28 so that the faces of the coin may be viewed through the openings 13 and 30.

In use, the frame sections 12 and 28 are separated after the spring 52 is removed from the outer edges thereof and a coin is mounted so that the edge 36 thereof fits into a portion of the groove 34 partially defined by one of the sections 12 or 28. After the coin is fit into the opening, the mating section of the frame is positioned so that the inner faces of the frame abut one another as illustrated in FIG. 2 and so that the boss members 42–51 are received in the openings 18–27 respectively. The half round inner edges 16 and 38 of the frame sections 12 and 28 respectively are thus positioned to receive the coil spring 52 which is stretched around the outer edges of the frame sections and the end 54 of spring 52 is inserted into the opening 56 so that the loops 58 are positioned at the top of the article to be displayed through the openings 13 and 30. In this manner, the loops 58 may be employed as a mounting member such as loops for the insertion of a chain when the frame section 10 is sufficiently small to be worn as a pendant.

Although the invention has been described by reference to some embodiments, it is not intended that the novel frame section be limited thereby but that modifications thereof are intended to be included as falling within the broad spirit and scope of the foregoing disclosure, the following claims, and the appended drawings.

What is claimed is:

1. A frame for encircling an article having a continuous edge comprising a first frame section having an outer face and an inner face, said first frame section extending around a first opening and having a first inner edge around said first opening, said first inner edge having a first flange means thereon projecting toward the center of said first opening, said first frame section having a first outer edge with indentation means therein, a second frame section having an outer face and an inner face, said second frame section extending around a second opening and having a second inner edge around said second opening, said second inner edge having a second flange means thereon projecting toward the center of said second opening, said second frame section having a second outer edge, the edges of said first opening and said second opening being substantially the same, a plurality of boss means extending from said second outer edge, resilient tying means for securing said first frame section to said second frame section so that when said first frame section and said second frame section are joined with the inner faces of each abutting one another said first flange means and said second flange means define a groove between them extending substantially towards the center of said first and second openings, said boss means are arranged to be received by said indentation means and said tying means is arranged to extend around the periphery of said first outer edge and said second outer edge so that a biasing force is applied from said periphery toward the centers of said first and second openings.

2. The frame of claim 1 where said tying means comprise a coil spring having a plurality of helically continuous coils and said connecting means comprises one end of said spring having an inwardly tapered configuration for insertion into an opening in the opposite end of said spring.

3. The frame of claim 2 where said frame comprises a pendant for mounting a coin in said groove formed between said first flange means and said second flange means, said first and second openings being rounded whereby the edge of a coin may be held in said groove and the faces of such coin may be viewed through the openings of said frame.

4. The pendant of claim 3 where one of said coils extends beyond the outer surface of said spring for securing a chain thereto.

* * * * *